US011407126B1

(12) United States Patent
Sharp

(10) Patent No.: US 11,407,126 B1
(45) Date of Patent: Aug. 9, 2022

(54) KNIFE WITH HANDLE INLAY

(71) Applicant: Christopher Sharp, Oxford, FL (US)

(72) Inventor: Christopher Sharp, Oxford, FL (US)

( * ) Notice: Subject to any disclaimer, the term of this patent is extended or adjusted under 35 U.S.C. 154(b) by 0 days.

(21) Appl. No.: 17/027,263

(22) Filed: Sep. 21, 2020

Related U.S. Application Data

(60) Provisional application No. 62/903,201, filed on Sep. 20, 2019.

(51) Int. Cl.
*B26B 1/02* (2006.01)

(52) U.S. Cl.
CPC ..... *B26B 1/02* (2013.01)

(58) Field of Classification Search
CPC .... B26B 1/00; B26B 1/02; B26B 1/04; B26B 1/042; B26B 1/044; B26B 1/046; B26B 1/048; B26B 1/06; B26B 1/08; B26B 1/10; B26B 5/00; B26B 11/001; B26B 11/003; B26B 11/008; B26B 29/00; B26B 29/02; B26B 29/025
See application file for complete search history.

(56) References Cited

U.S. PATENT DOCUMENTS

D25,560 S 6/1896 Smith
D25,561 S 6/1896 Smith
D25,562 S 6/1896 Smith
1,498,886 A * 6/1924 Platts ..... B26B 1/10 40/661.12
D118,622 S * 1/1940 Haydel ..... D8/100
3,783,509 A 1/1974 Lake
5,694,692 A * 12/1997 Reinschreiber ..... B26B 1/042 30/155
5,826,340 A 10/1998 Hull
D438,086 S * 2/2001 Ahlund ..... D8/100
D488,697 S 4/2004 Rae
D554,964 S 11/2007 Taylor
D562,102 S 2/2008 Pearman
7,380,340 B1 6/2008 Lerch
D582,243 S 12/2008 Freeman et al.
7,721,448 B2 5/2010 Kao
8,443,521 B2 5/2013 Klecker
8,863,394 B2 10/2014 Lo
D763,056 S * 8/2016 Mihailides ..... D8/99
D777,552 S * 1/2017 Miller ..... D8/100
9,808,939 B2 11/2017 Gutierrez
D825,310 S * 8/2018 Liu ..... D8/99
10,688,672 B1 * 6/2020 Perez ..... B26B 1/04
10,780,592 B2 * 9/2020 Liang ..... B26B 1/10
D907,458 S * 1/2021 Ronan ..... D8/99
(Continued)

*Primary Examiner* — Jonathan G Riley
(74) *Attorney, Agent, or Firm* — John Rizvi; John Rizvi, P.A.—The Patent Professor®

(57) ABSTRACT

A foldable knife having a handle inlay through which the knife blade can be viewed may include a knife handle having an interior handle liner and at least one outer handle portion on the handle liner. At least one knife handle inlay may be provided in the knife handle. The knife handle inlay may include a walled or ridged inlay structure which extends from the handle liner and has a selected size and shape. An inlay window may extend through the outer handle portion. The inlay window may generally correspond to a size and shape of the inlay structure and the inlay structure extends through the inlay window.

14 Claims, 5 Drawing Sheets

(56) References Cited

U.S. PATENT DOCUMENTS

| | | | | |
|---|---|---|---|---|
| 2008/0086894 | A1* | 4/2008 | Sullivan | B26B 5/00 30/155 |
| 2010/0242287 | A1* | 9/2010 | Jameson | A63F 9/12 30/157 |
| 2016/0303748 | A1* | 10/2016 | Martinez | B26B 1/02 |
| 2018/0290313 | A1 | 10/2018 | Scimone et al. | |
| 2019/0366567 | A1* | 12/2019 | Mitchell | B26B 1/02 |
| 2020/0307003 | A1* | 10/2020 | Berman | B25F 1/04 |
| 2021/0008737 | A1* | 1/2021 | Cauley, Jr | B25G 1/102 |

* cited by examiner

KNIFE WITH HANDLE INLAY

CROSS-REFERENCE TO RELATED APPLICATIONS

This application claims the benefit of U.S. Provisional Patent Application No. 62/903,201, filed on Sep. 20, 2019, which is incorporated by reference herein in its entirety.

FIELD OF THE INVENTION

The present invention relates generally to knives, and more particularly, to a foldable knife having a handle inlay that can serve the dual purpose of providing a decorative symbol or shape which is visible from outside the knife, and providing the handle with a window through which the knife blade can be viewed.

BACKGROUND OF THE INVENTION

Various types of cutting implements have been known to man for several millennia. Most importantly, knives have been used by humans since more than two million years ago, allowing humans to hunt, combat, cut, eat, and carry out a myriad of other actions. Knives may have evolved in design and complexity throughout time, but their overall configuration remains unaltered. Essentially, a knife includes a blade which has a cutting edge and extends from a handle. While knives were originally made of stone or the bone of an animal, modern knives are fabricated of metals, alloys, ceramics, composites and/or other materials.

Knives typically have either a fixed blade or a folding blade. Fixed-blade knives have a blade which is in a fixed extended configuration relative to the handle, i.e. the blade cannot move or rotate in relation to the handle. Folding knives, on the contrary, have a blade that is movable relative to the handle and can be deployed in a folded position inside the handle or in an extended position from the handle. Pocket knives are a common type of folding knife which can be carried in a user's pocket and retrieved when use is needed. Some types of folding knives have a blade-locking mechanism which locks the blade in the extended, functional position. The lock mechanism can be released to facilitate folding of the blade back into the handle.

The handle of a knife can be customized in many different ways to express the aesthetic tastes of a user. For example, some knives have handles which are constructed of the horn or tusk of an animal. Other knives have handles which are constructed of jewels or materials which resemble the appearance of jewels. Still other knife handles are made of plastic, metal, wood, composites or other materials. Wooden handles can be carved and ornamented in a variety of ways depending on the tastes of the user.

Some knife handles may be fabricated with an inlay which is of a different material or appearance than that of the material of which the rest or outside of the handle is made. In fixed blade knives, the inlay and blade may be formed into a single-piece unit made for instance of metal. In folding knives, the inlay and handle may be pivotably connected to one another. The rest or outside of the handle can be made of wood, plastic or other materials which may optionally contrast with the inlay, which may be partially visible.

The goal of the present invention is to provide a folding knife design having an inlay which serves alternative or additional purposes to providing a pivoting connection for the blade to rotate relative to the handle.

SUMMARY OF THE INVENTION

The present invention is directed to a foldable knife having a handle inlay extending through the handle. The foldable knife may include a knife handle. A knife blade may be selectively extendable from and foldable into the knife handle. The knife handle may have an interior handle liner. At least one outer handle portion may be provided on the handle liner. At least one knife handle inlay may be provided in the knife handle. The knife handle inlay may include a walled or ridged inlay structure which extends from the handle liner and has a selected size and shape. An inlay window which generally corresponds to the size and shape of the inlay structure may extend through the outer handle portion. The inlay structure may extend at least partially through the inlay window such that the inlay structure can be viewed from outside the knife handle.

In a first implementation of the invention, a foldable knife may include a knife handle having an interior handle liner and one or more handle portions at least partially covering the handle liner. The foldable knife may further include a knife blade pivotably attached to the knife handle and movable between a folded position and an extended position relative to the knife handle. Furthermore, the foldable knife may be provided with at least one knife handle inlay provided in the knife handle. Each knife handle inlay may include an inlay structure and an inlay window. The inlay structure may extend from the handle liner and includes one or more walls protruding from the handle liner, wherein a space may be defined within the one or more walls. The inlay window may extend through a handle portion of the one or more handle portions, and may correspond in size and shape with the inlay structure. The inlay structure may extend at least partially through the inlay window.

In a second aspect, the inlay structure may be visible from outside the knife handle.

In another aspect, an outer edge of the inlay structure may be flush with an outer side of the handle portion of the one or more handle portions.

In another aspect, the inlay structure may protrude outwardly from the handle portion of the one of more handle portions.

In another aspect, the inlay structure may fit snugly into the inlay window.

In yet another aspect, the one or more walls of the inlay structure may be formed integrally with the handle liner from which the inlay structure extends.

In another aspect, the space of the inlay structure may face a through opening formed through the handle liner, and the knife blade may be visible through the space and the through opening and from outside the knife handle when the knife blade is arranged in the folded position.

In another aspect, the knife blade may include a visible mark configured to face the through opening in the handle liner and the space of the inlay structure and to be visible through the knife handle inlay when the knife blade is arranged in the folded position.

In another aspect, the visible mark may be configured to move out of alignment with respect to the through opening in the handle liner and the space of the inlay structure when the knife blade is moved from the folded position towards the extended position.

In yet another aspect, a surface of the handle liner may be visible through the knife handle inlay when the knife blade is arranged in the extended position.

In another aspect, the surface of the handle liner may include a visible mark configured to be visible through the knife handle inlay when the knife blade is arranged in the extended position.

In another aspect, the inlay structure may extend from and surrounds a solid portion of the handle liner and the space of the inlay structure faces the solid portion of the handle liner. The knife blade may be blocked from being viewed through the space and the through opening and from outside the knife handle by the solid portion of the handle liner when the knife blade is arranged in the folded position.

In another aspect, the handle liner may include a first liner plate and a second liner plate, with the first and second liner plates arranged in spaced-apart configuration. The knife blade may be pivotably movable between the first and second liner plates.

In yet another aspect, the one or more handle portions may include a first handle portion at least partially covering the first liner plate, and a second handle portion at least partially covering the second liner plate. A knife handle inlay of the at least one knife handle inlay may be provided on at least one of the first handle portion and the second handle portion.

In another aspect, the at least one knife handle inlay may include a first knife handle inlay carried by the first liner plate and a second knife handle inlay carried by the second liner plate. The first and second knife handle inlays may be arranged on opposite sides of the knife handle and opposite to one another.

In yet another aspect, the space of the inlay structure of the first knife handle inlay may face a first through opening formed through the first liner plate, and the space of the inlay structure of the second knife handle inlay may faces a second through opening formed through the second liner plate. The space of the inlay structure of the first knife handle inlay and the first through opening may be aligned with the space of the inlay structure of the second knife handle inlay and the second through opening allowing to see through the first and second knife handle inlays when the knife blade is arranged in the extended position.

In another aspect, the space of the inlay structure of the first knife handle inlay may face a through opening formed through the first liner plate. In turn, the inlay structure of the second knife handle inlay may instead extend from and surround a solid portion of the second liner plate and the space of the inlay structure of the second knife handle inlay may face the solid portion of the second liner plate.

In another aspect, the inlay structure of the first knife handle inlay may extend from and surround a first solid portion of the first liner plate and the space of the inlay structure of the first knife handle inlay may face the solid portion of the first liner plate. Similarly, the inlay structure of the second knife handle inlay may extend from and surround a second solid portion of the second liner plate and the space of the inlay structure of the second knife handle inlay may face the second solid portion of the second liner plate.

In another aspect, the inlay structure of the knife handle inlay may have any of a variety of sizes and shapes.

In yet another aspect, the knife handle inlay may be included on single-bolster knives or double-bolster knives.

In another aspect, the knife handle inlay may include a logo, image, symbol or other element.

In another aspect, the outer handle portion may be metal, wood and/or plastic.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Shown throughout the figures, the present invention is directed toward a foldable knife having a handle inlay serving a dual purpose of providing a decorative symbol or shape which is visible from outside the knife, and providing the handle with a window through which the knife blade can be viewed.

Figure 1:
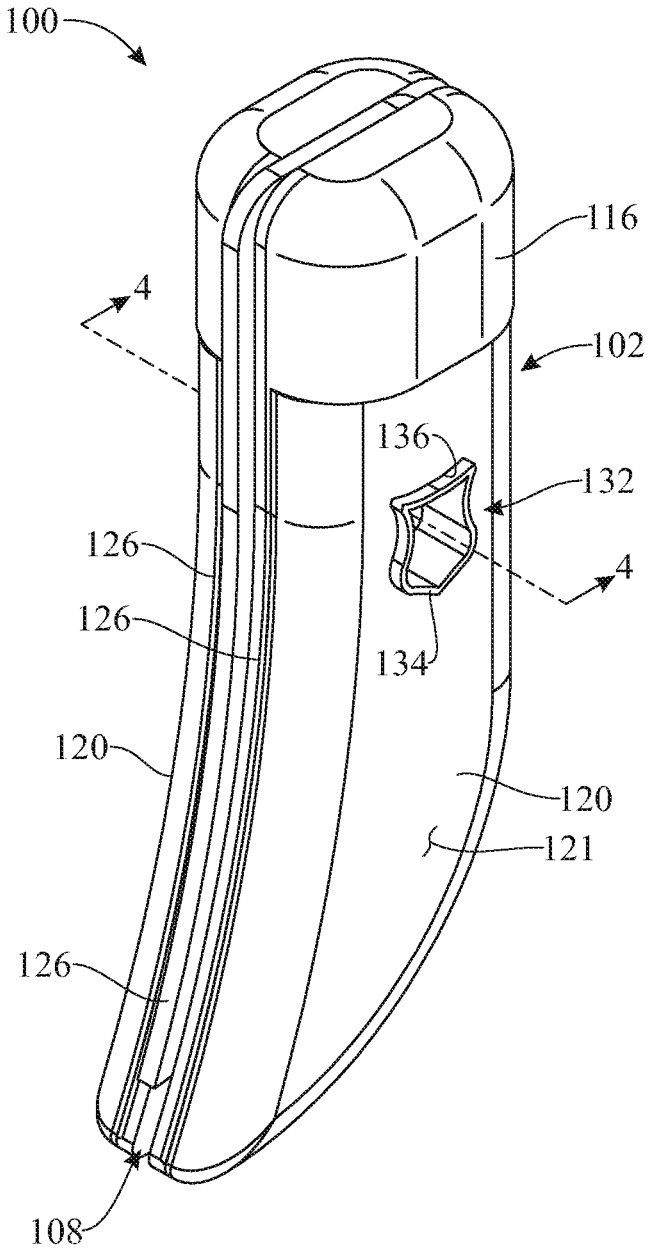
FIG. 1 presents a perspective view showing an illustrative embodiment of the knife with handle inlay of the present invention with the knife blade folded into the knife handle.
Figure 2:
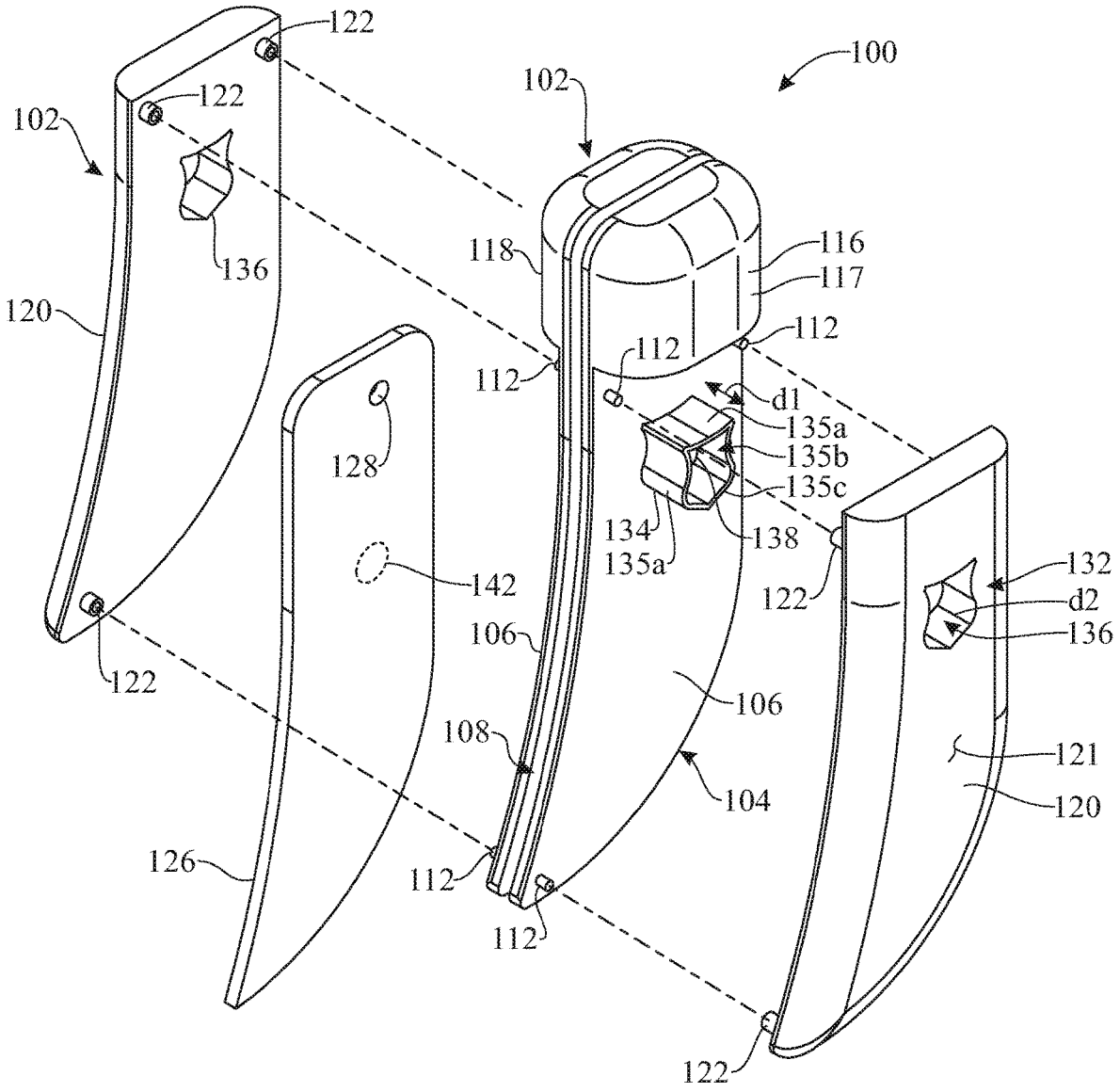
FIG. 2 presents an exploded perspective view of the illustrative embodiment of the knife with handle inlay of the present invention.

Referring initially to FIGS. 1-4, a knife with handle inlay, hereinafter knife, in accordance with an exemplary embodiment of the present invention is generally indicated by reference numeral 100. The knife 100 may be a single-bolster or double-bolster knife and may include a knife handle 102. As illustrated in FIG. 2, the knife handle 102 may include an interior, handle liner 104. The handle liner 104 may be made of metal and/or other suitable material and may include a pair of elongated liner plates 106 which are parallel and spaced apart relative to one another such that a slot or space is formed between the liner plates 106. The liner plates 106 may extend from a handle head 116. The handle head 116 may include two spaced apart, handle head portions 117, 118 which extend from each of the two liner plates 106, respectively. A slot or space is formed between the handle head portions 117, 118 in spatial continuation with the slot or space that is formed between the liner plates 106. In some embodiments, such as the present embodiment, each handle head portion 117, 118 may be integrally-formed into a single-piece unit with the respective liner plate 106 from which the handle head portion 117, 118 extends.

Figure 3:
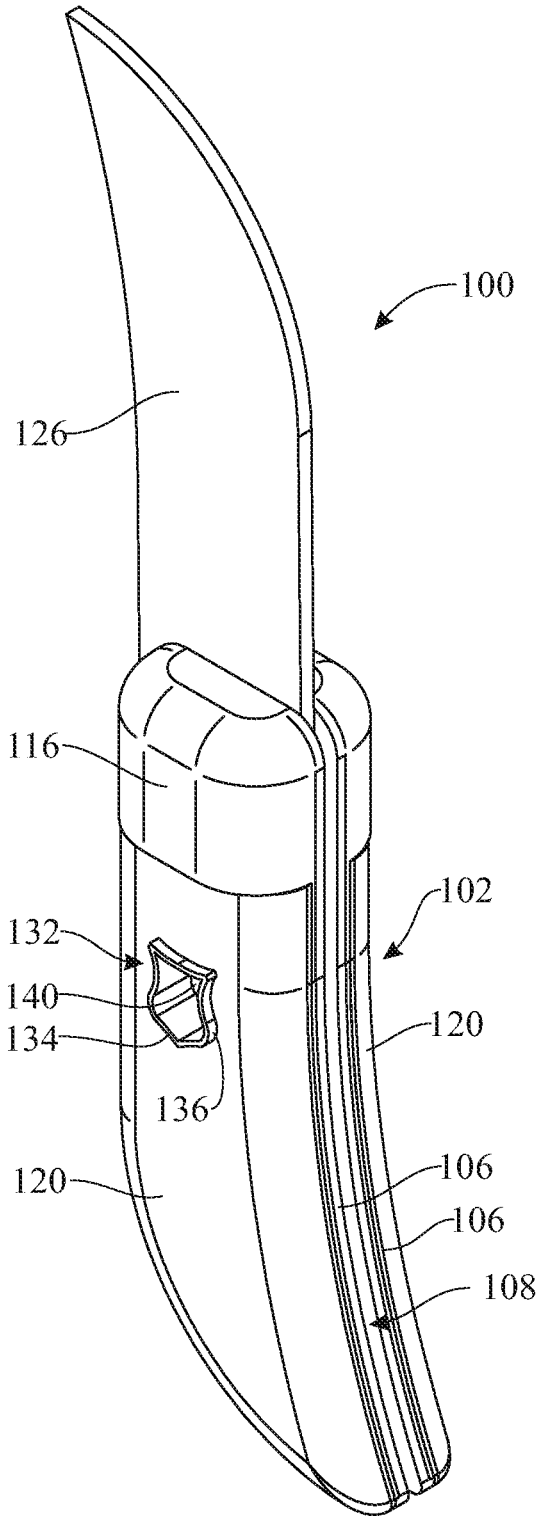
FIG. 3 presents a perspective view showing an illustrative embodiment of the knife with handle inlay of the present invention with the knife blade extended from the knife handle.

The slot between the handle head portions 117, 118 and slot between the liner plates 106 jointly form a blade space 108. A knife blade 126 may be pivotally mounted in the blade space 108 according to the knowledge of those skilled in the art. In some embodiments, a blade mount pin (not illustrated) may span the blade space 108, between the liner plates 106 or between the handle head portions 117, 118. A pivot pin opening 128 may extend through the knife blade 126, and the blade mount pin may extend through the pivot pin opening 128, allowing the knife blade 126 to pivot relative to a rotation axis provided by the pivotable connection formed at the blade mount pin and pivot pin opening 128. The knife blade 126 may be selectively deployable between a folded position in which the knife blade 126 is pivoted inside the blade space 108, as illustrated in FIG. 1, and an extended position in which the knife blade 126 is pivoted outward of the knife handle 102 and extends distally from the knife handle 102, as illustrated in FIG. 3.

With reference to FIG. 2, the knife handle 102 may further include at least one outer handle portion 120 provided on the handle liner 104, to increase the thickness and/or robustness of the knife handle 102, and/or to provide a desired aesthetic finish to the knife handle 102. In some embodiments, more specifically, a pair of outer handle portions 120 may be provided on the handle liner 104, one on each side of the handle liner 104. As illustrated, the outer handle portions 120 may be attached to opposite outside faces of the respective liner plates 106 of the handle liner 104. For instance and without limitation, the outer handle portions 120 may be installed by inserting liner pins 112 which may extend from each liner plate 106 into respective pin receptacles 122 which may be provided in each outer handle portion 120. Each outer handle portion 120 may be made of wood, plastic, metal, composite and/or other materials.

At least one knife handle inlay 132 may be provided in the knife handle 102. In some embodiments, a plurality of knife handle inlays 132 may be provided in the knife handle 102. For instance and without limitation, in some embodiments, at least one knife handle inlay 132 may be provided in each of the outer handle portions 120 of the knife handle 102. Each knife handle inlay 132 may include a walled or ridged inlay structure 134 extending or protruding from the handle liner 104, wherein the inlay structure 134 may be formed by one or more walls 135*a* surrounding a cavity or space 135*b*, as shown. The inlay structure 134 may extend outwardly from at least one of the liner plates 106 of the handle liner 104. For instance, in the present embodiment, each liner plate 106 carries a corresponding inlay structure 134 that extends from and outward of the liner plate 106. The inlay structure 134 may be shaped as a logo, image, symbol and/or other element and may have a selected size and shape. In the non-limiting embodiment illustrated in FIGS. 1-4, the inlay structure 134 has the shape of a badge. In some embodiments; the inlay structure 134 may be cast, molded, machined and/or otherwise formed integrally in one piece with the liner plate 106 of the handle liner 104 according to the knowledge of those skilled in the art. In other embodiments, the inlay structure 134 may be fabricated separately and attached to the liner plate 106 according to the knowledge of those skilled in the art.

As best shown in FIG. 2, the knife handle inlay 132 may further include an inlay window 136 which extends through the outer handle portion 120. The inlay window 136 may generally correspond to the shape of the inlay structure 134. The inlay window 136 may be sized only slightly larger than the inlay structure 134 such that the inlay window 136 can receive and snugly accommodate the inlay structure 134 as the outer handle portion 120 is attached to the liner plate 106 of the handle liner 104. In some embodiments, such as the present embodiment, the inlay structure 134 and inlay window 136 are configured to non-rotationally couple with one another, such that the inlay structure 134 is non-rotational within, and relative to, the inlay window 136 when the inlay structure 134 is fitted into the inlay window 136; for instance, the inlay structure 134 and inlay window 136 may be non-circular and configured to non-rotationally fit. Such non-rotational engagement between the inlay structure 134 and inlay window 136 contributes to more securely attach the outer handle portion 120 to the liner plate 106.

Figure 4:
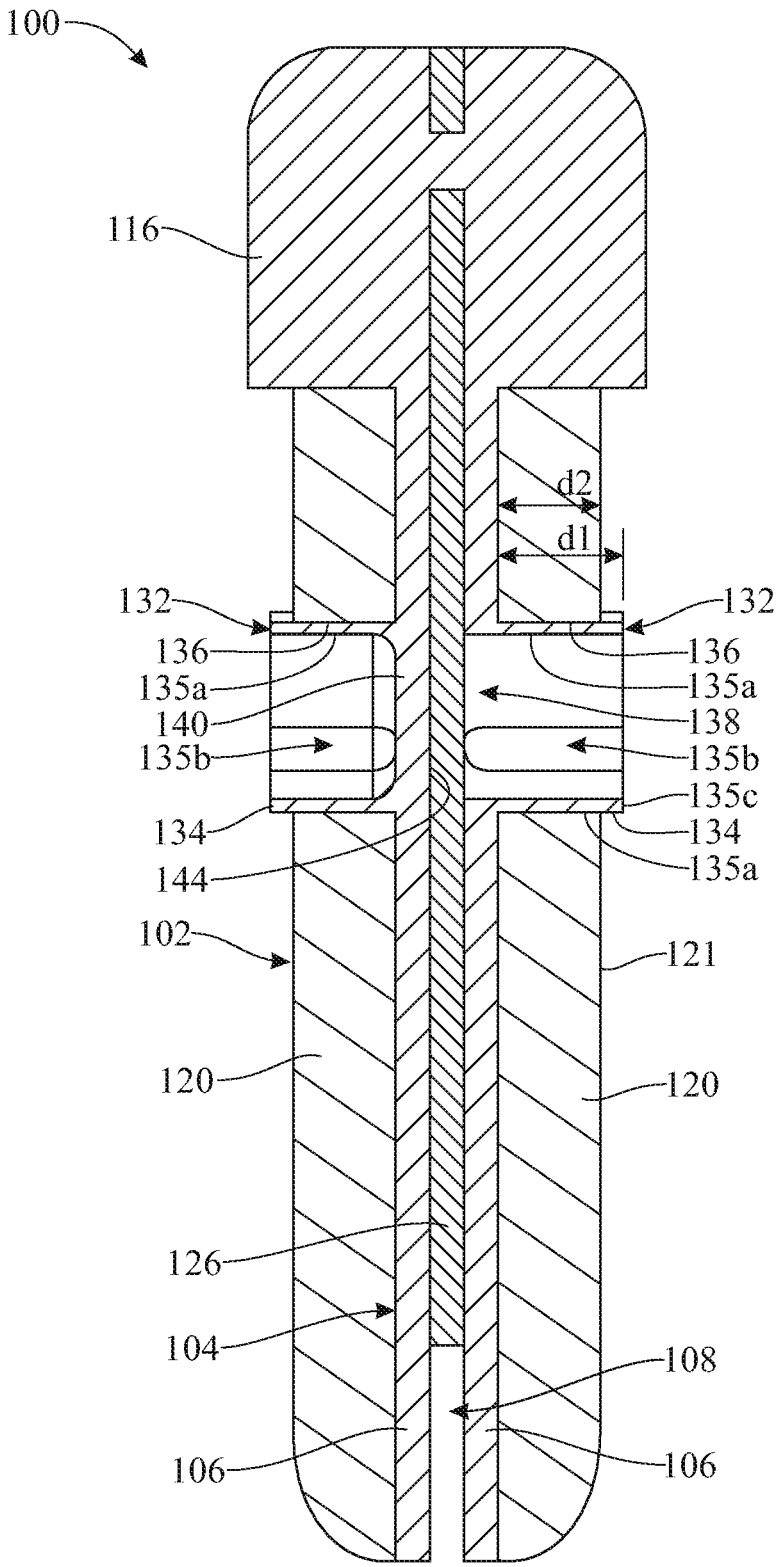
FIG. 4 presents a longitudinal sectional view of the knife with handle inlay of the present invention, taken along section lines 4-4 in FIG. 1.

Furthermore, the inlay structure 134 may be sized such that it extends sufficiently through the inlay window 136 to allow the inlay structure 134 to be visible from outside the outer handle portion 120, and also to contribute to a more stable mounting of the handle portion 120 on the liner plate 106. For instance, in some embodiments, such as the present embodiment, the inlay structure 134 length d1 may be slightly larger than the inlay window 136 thickness d2 such that the inlay structure 134 protrudes slightly outwardly from an outer side 121 of the outer handle portion 120 when the outer handle portion 120 is attached to the liner plate 106, as best shown in FIGS. 1 and 4. In other embodiments, d1 and d2 may be substantially equal, such that an outer edge 153*c* of the inlay structure 134 is flush with the outer side 121 of the handle portion 120 when the outer handle portion 120 is attached to the liner plate 106. The visible or protruding inlay structure 134 may provide a decorative metallic contour to the inlay window 136, for instance and without limitation.

In some embodiments, the inlay structure 134 may surround an opening 138 formed through the liner plate 106. I.e., the liner plate 106 includes an opening 138 which extends through the liner plate 106 and is surrounded by the wall or walls 135*a* of the inlay structure 134, with the inlay structure 134 formed as an outwardly-protruding wall assembly extending around the opening 138, with the space 135*b* defined by the wall(s) 135*a* in spatial communication with the opening 138. Alternatively or additionally, one or more of the inlay structures 134 may be formed surrounding respective solid portions 140 of the liner plate 106; i.e., the liner plate 106 may include a solid portion 140 or floor around which the inlay structure 134 extends and protrudes outwardly form, with the solid portion 140 facing the space 135*b* of the inlay structure 134. In some embodiments, all inlay structures 134 may extend around a respective opening 138 formed through the liner plate 106. In other embodiments, all or some of the inlay structures 134 may instead extend around a respective solid portion 140 or floor on the liner plate 106. For instance, as best shown in FIG. 4, the present embodiment is such that the inlay structure 134 on one of the liner plates 106 extends around a solid portion 140 of the liner plate 106 while the inlay structure 134 on the opposite liner plate 106 extends around a window or through opening 138 formed through the liner plate 106.

As mentioned heretofore, the knife blade 126 can pivotably move between a folded position (FIGS. 1 and 4) and an extended position (FIG. 3). In dependence of the construction and/or materials used, various aesthetic and/or functional effects may be obtained while using the knife 100.

For example, in the event that one or more of the inlay structures 134 are arranged surrounding an opening 138 formed through the liner plate 106 (e.g., the inlay structure 134 on the right-hand side of FIG. 4), the knife blade 126 may then be viewed through the inlay structure 134 and corresponding opening 138 when the knife blade 126 is arranged in the folded position. In some embodiments, the knife blade 126 may be provided with a visible mark 142 (FIG. 2) configured to become aligned with the opening 138 of the liner plate 106 when the knife blade 126 is in the folded position, to serve as an indicator that the knife blade 126 has correctly adopted the folded position, with the liner plate 106 completely folded into the knife handle 102. Thus, when closing the knife 100, the user may know the knife 100 is successfully and completely folded once the visible mark 142 becomes aligned with the opening 138 and becomes visible through the knife handle inlay 132; if, instead, the user has folded the knife blade 126 without the visible mark 142 becoming visible through the opening 138 or only partially aligned with or visible through the opening 138, this will serve as an indicator to the user that the knife blade 126 is only partially folded, allowing the user to become aware of the safety risk and to responsively fully close the knife blade 126.

In another example, in the event that one inlay structure 134 is arranged surrounding an opening 138 formed through the liner plate 106, and an opposed, inlay structure 134 is arranged surrounding a solid portion 140 of the liner plate 106 (as in the present embodiment), the solid portion 140 will become visible through the opposed opening 138 and inlay structure 134 when the knife blade 126 is arranged in the extended position. In some embodiments, an inner side 144 of the solid portion 140 may be provided with a color, visible mark, indicia, texture, or the like, configured to become visible through the opposed opening 138 and inlay structure 134 when the knife blade 126 is arranged in the open position, such as to provide an aesthetic visual effect and/or a visual indicator that the knife blade 126 has been correctly opened to the fully extended position.

In yet another example, in the event that the knife 100 includes two opposed inlay structures 134 formed around respective openings 138 and the openings 138 are arranged facing one another (similarly to opening 138 and solid portion 140 in the present embodiment), the user may see through the aligned openings 138 when the knife blade 126 is arranged in the open position, providing yet another interesting or aesthetic visual effect. In addition, in such example, the knife blade 126 may be provided with one visible mark 142 on each side of the blade, the visible marks 142 configured to align with the respective openings 138 when the knife blade 126 is correctly and completely folded into the knife handle 102. The knife will thus provide visual indications on both sides of the knife handle 102 that the blade has been safely folded into the handle, contributing to facilitate more rapidly sighting one of the visual indications.

Figure 5:
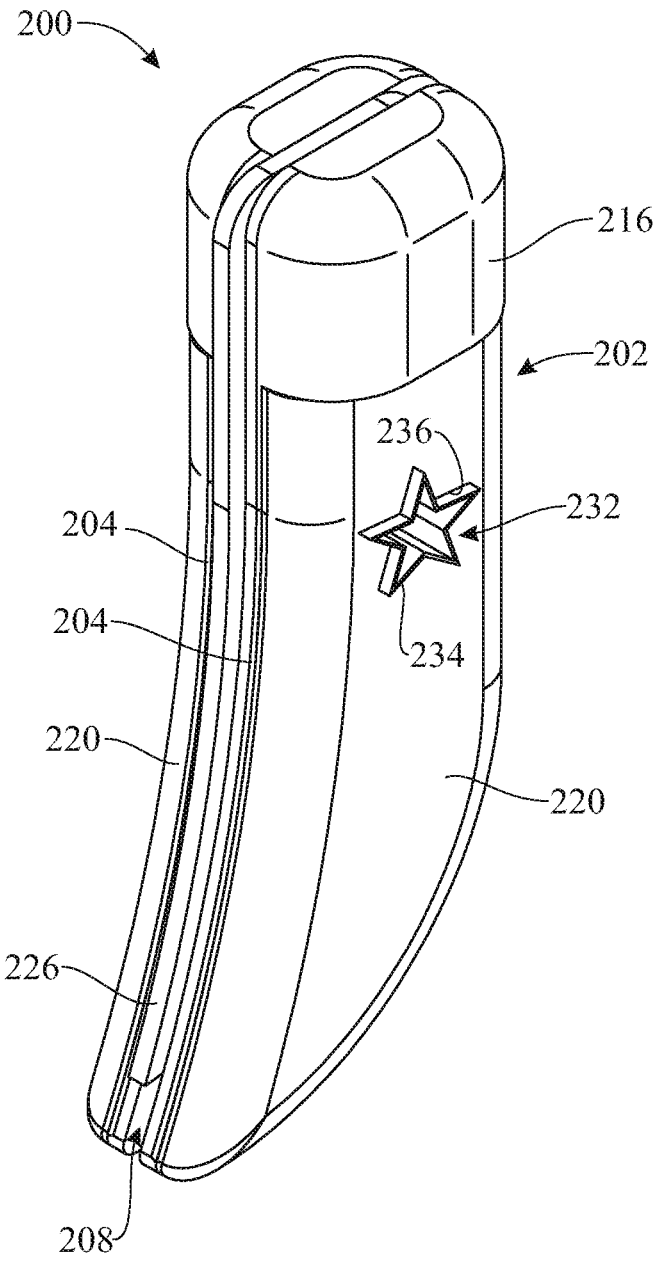
FIG. 5 presents a perspective view showing an alternative illustrative embodiment of the knife with handle inlay of the present invention with the knife blade folded into the knife handle.

Referring next to FIG. 5 of the drawings, an alternative illustrative embodiment of the knife with handle inlay is generally indicated by reference numeral 200. In the knife 200, elements which are analogous to the respective elements of the knife 100 that was heretofore described with respect to FIGS. 1-4 are designated by the same respective numerals in the 200-299 series in FIG. 5. Similarly to the previous embodiment, the foldable knife 200 of the present embodiment includes a knife handle 202 and a knife blade 226 pivotably attached to the knife handle 202 and movable between a folded position and an extended position relative to the knife handle 202. The knife handle 202 includes an interior handle liner 204 and at least one outer handle portion 220 on the handle liner 204. At least one knife handle inlay 232 is provided in the knife handle 202. The knife handle inlay 232 is comprised of a walled or ridged inlay structure 234 extending from the handle liner 204 and having a selected size and shape. The knife handle inlay 232 further includes an inlay window 236 extending through the at least one outer handle portion 220. The inlay window 236 generally corresponds to the size and shape of the inlay structure 234 and the inlay structure 234 extends at least partially through the inlay window 236.

As can be seen, the knife handle inlay 232 of the knife 200 in accordance with the second embodiment, however, has a star shape. As was set forth herein above, further alternative shapes of the knife handle inlay 232 are possible, wherein the shapes may be the same or different relative to each other.

Since many modifications, variations, and changes in detail can be made to the described preferred embodiments of the invention, it is intended that all matters in the foregoing description and shown in the accompanying drawings be interpreted as illustrative and not in a limiting sense. Furthermore, it is understood that any of the features presented in the embodiments may be integrated into any of the other embodiments unless explicitly stated otherwise. The scope of the invention should be determined by the appended claims and their legal equivalents.

What is claimed is:

1. A foldable knife, comprising:

a knife handle, comprising an interior handle liner and one or more handle portions at least partially covering the interior handle liner;

a knife blade pivotably attached to the knife handle and movable between a folded position and an extended position relative to the knife handle; and at least one knife handle inlay provided in the knife handle, each knife handle inlay including:

an inlay structure extending from the interior handle liner, the inlay structure comprising one or more walls protruding from the interior handle liner, wherein a space is defined within the one or more walls, wherein the space extends from a through opening formed in the interior handle liner, and an inlay window extending through a handle portion of the one or more handle portions, the inlay window corresponding in size and shape with the one or more walls protruding from the interior handle liner, wherein the inlay structure extends at least partially through the inlay window; wherein the knife blade is visible through the space of the inlay structure and the through opening formed in the interior handle liner from outside the knife handle when the knife blade is arranged in the folded position.

2. The foldable knife of claim 1, wherein the inlay structure is visible from outside the knife handle.

3. The foldable knife of claim 2, wherein an outer edge of the one or more walls protruding from the interior handle liner is flush with an outer side of the handle portion of the one or more handle portions.

4. The foldable knife of claim 2, wherein the one or more walls protruding from the interior handle liner protrude outwardly from the handle portion of the one of more handle portions.

5. The foldable knife of claim 1, wherein the one or more walls of the inlay structure are formed integrally with the interior handle liner from which the inlay structure extends.

6. The foldable knife of claim 1, wherein the knife blade comprises a visible mark configured to face the through opening in the interior handle liner and the space of the inlay structure and to be visible through the knife handle inlay when the knife blade is arranged in the folded position.

7. The foldable knife of claim 6, wherein the visible mark is configured to move out of alignment with respect to the through opening in the interior handle liner and the space of the inlay structure when the knife blade is moved from the folded position towards the extended position.

8. The foldable knife of claim 1, wherein a surface of a second interior handle liner is visible through the knife handle inlay when the knife blade is arranged in the extended position.

9. The foldable knife of claim 8, wherein the surface of the second interior handle liner comprises a visible mark configured to be visible through the knife handle inlay when the knife blade is arranged in the extended position.

10. The foldable knife of claim 1, wherein the interior handle liner comprises a first liner plate and a second liner plate, the first and second liner plates arranged in spaced-apart configuration, and further wherein the knife blade is pivotably movable between the first and second liner plates.

11. The foldable knife of claim 10, wherein the one or more handle portions comprise a first handle portion at least partially covering the first liner plate, and a second handle portion at least partially covering the second liner plate, wherein a knife handle inlay of the at least one knife handle inlay is provided on at least one of the first handle portion and the second handle portion.

12. The foldable knife of claim 10, wherein the at least one knife handle inlay comprises a first knife handle inlay carried by the first liner plate and a second knife handle inlay carried by the second liner plate, and further wherein the first and second knife handle inlays are arranged on opposite sides of the knife handle and opposite to one another.

13. A foldable knife, comprising:

a knife handle, comprising an interior handle liner and one or more handle portions at least partially covering the interior handle liner comprising a first liner plate and a second liner plate, the first and second liner plates arranged in spaced-apart configuration;

a knife blade pivotably attached to the knife handle and movable between the first and second liner plates, the knife blade movable between a folded position and an extended position relative to the knife handle; and at least one knife handle inlay provided in the knife handle, each knife handle inlay including:

a first knife handle inlay carried by the first liner plate and a second knife handle inlay carried by the second liner plate, the first and second knife handle inlays arranged on opposite sides of the knife handle and opposite to one another;

an inlay structure extending from the interior handle liner, the inlay structure comprising one or more walls protruding from the interior handle liner, wherein a space is defined within the one or more walls, and an inlay window extending through a handle portion of the one or more handle portions, the inlay window corresponding in size and shape with the one or more walls protruding from the interior handle liner, wherein the inlay structure extends at least partially through the inlay window; wherein the space of the inlay structure of the first knife handle inlay extends from a first through opening formed through the first liner plate, and the space of the inlay structure of the second knife handle inlay extends from a second through opening formed through the second liner plate, and further wherein the space of the inlay structure of the first knife handle inlay and the first through opening are aligned with the space of the inlay structure of the second knife handle inlay and the second through opening allowing to see through the first and second knife handle inlays when the knife blade is arranged in the extended position.

14. A foldable knife, comprising:

a knife handle, comprising an interior handle liner and one or more handle portions at least partially covering the interior handle liner comprising a first liner plate and a second liner plate, the first and second liner plates arranged in spaced-apart configuration;

a knife blade pivotably attached to the knife handle and movable between the first and second liner plates, the knife blade movable between a folded position and an extended position relative to the knife handle; and at least one knife handle inlay provided in the knife handle, each knife handle inlay including:

a first knife handle inlay carried by the first liner plate and a second knife handle inlay carried by the second liner plate, the first and second knife handle inlays arranged on opposite sides of the knife handle and opposite to one another;

an inlay structure extending from the interior handle liner, the inlay structure comprising one or more walls protruding from the interior handle liner, wherein a space is defined within the one or more walls, and an inlay window extending through a handle portion of the one or more handle portions, the inlay window corresponding in size and shape with the one or more walls protruding from the interior handle liner, wherein the inlay structure extends at least partially through the inlay window; wherein the space of the inlay structure of the first knife handle inlay extends from a through opening formed through the first liner plate, and wherein the inlay structure of the second knife handle inlay extends from and surrounds a solid portion of the second liner plate and the space of the inlay structure of the second knife handle inlay faces said solid portion of the second liner plate.

* * * * *